US005936592A

United States Patent [19]

Ramanujam et al.

[11] Patent Number: 5,936,592

[45] Date of Patent: Aug. 10, 1999

[54] RECONFIGURABLE MULTIPLE BEAM SATELLITE REFLECTOR ANTENNA WITH AN ARRAY FEED

[76] Inventors: Parthasarathy Ramanujam, 2601 Fisk La., Redondo Beach, Calif. 90278; Sudhakar K. Rao, 20326 Mansel Ave., Torrance, Calif. 90503; Robert E. Vaughan, 1659 5th St., Manhattan Beach, Calif. 90266; James C. McCleary, 4012 W. 149th St., Lawndale, Calif. 90260

[21] Appl. No.: 09/092,510

[22] Filed: Jun. 5, 1998

[51] Int. Cl.[6] ..... H01Q 21/00

[52] U.S. Cl. ..... 343/853; 343/778; 342/373

[58] Field of Search ..... 343/700 MS, 754, 343/778, 779, 853, 854, 901; 342/372, 373, 374

[56] References Cited

U.S. PATENT DOCUMENTS

| | | | |
|---|---|---|---|
| 3,731,316 | 5/1973 | Sheleg | 343/778 |
| 4,408,205 | 10/1983 | Hockham . | |
| 4,799,065 | 1/1989 | Thompson . | |
| 4,939,527 | 7/1990 | Lamberty et al. | 343/778 |
| 4,962,383 | 10/1990 | Tresselt | 343/700 MS |
| 4,965,587 | 10/1990 | Lenormand et al. . | |
| 4,965,588 | 10/1990 | Lenormand et al. . | |
| 5,115,248 | 5/1992 | Roederer . | |
| 5,289,193 | 2/1994 | Lenormand et al. . | |
| 5,548,295 | 8/1996 | Forti et al. | 342/373 |
| 5,689,272 | 11/1997 | Harrison et al. | 342/373 |
| 5,784,030 | 7/1998 | Lane et al. | 342/373 |

*Primary Examiner*—Don Wong
*Assistant Examiner*—Tho Phan
*Attorney, Agent, or Firm*—Terje Gudmestad; Georgann Grunebach; Michael W. Sales

[57] ABSTRACT

A reconfigurable multiple beam array antenna for transmitting beams includes a reflector and radiating elements for feeding beam signals to the reflector. The array antenna includes a reconfigurable beam forming network having a plurality of dividers, a plurality of adjustable phase shifter and attenuator pairs, and a plurality of combiners to form beam signals from beam signals input to the beam forming network. A first hybrid matrix formed by an association of couplers is connected to the beam forming network for receiving the beam signals. Amplifiers receive and amplify the beam signals from the first hybrid matrix. A second hybrid matrix formed by an association of couplers is connected to the amplifiers for receiving the beam signals. The second hybrid matrix provides the amplified beam signals to the radiating elements for the reflector to transmit beams.

14 Claims, 5 Drawing Sheets

RECONFIGURABLE MULTIPLE BEAM SATELLITE REFLECTOR ANTENNA WITH AN ARRAY FEED

TECHNICAL FIELD

The present invention relates generally to array antennas and, more particularly, to reconfigurable multiple beam array antennas.

BACKGROUND ART

The advent of wireless forms of communication necessitated the need for antennas. Antennas are required by communications and radar systems, and depending upon the specific application, antennas can be required for both transmitting and receiving signals. Early stages of wireless communications consisted of transmitting and receiving signals at frequencies below 1 MHz which resulted in signal wavelengths greater than 0.3 km. A problem with such relatively large wavelengths is that if the size of the antenna is not at least equal to the wavelength, then the antenna is not capable of directional transmission or reception. In more modern forms of wireless communications, such as with communications satellites, the frequency range of transmitted signals has shifted to the microwave spectrum where signal wavelengths are in the 1.0 cm to 30.0 cm range. Therefore, it is practical for antennas to have sizes much greater than the signal wavelength and achieve highly directional radiation beams.

Many antennas have requirements for high directivity, high angular resolution, and the ability to electronically scan or be reconfigured. These functions are typically accomplished using an array antenna. An array antenna includes a collection of radiating elements closely arranged in a predetermined pattern and energized to produce beams in specific directions. When elements are combined in an array, constructive radiation interference results in a main beam of concentrated radiation, while destructive radiation interference outside the main beam reduces stray radiation. To produce desired radiation patterns, each individual radiating element is energized with the proper phase and amplitude relative to the other elements in the array.

In satellite communications systems, signals are typically beamed between satellites and fixed coverage region(s) on the Earth. With the expanding applications of satellites for many different aspects of communications, market requirements are continuously changing. Accordingly, a satellite must be capable of adapting to changes in the location of the service requests. Thus, antennas provided on satellite must be capable of reconfigurable coverages.

A reconfigurable multiple beam array antenna is an ideal solution to the ever changing beam coverage requirements. Beam coverage can be in the form of a number of spot beams and regional beams located over specific regions. Spot beams cover discrete and separate areas such as cities. Regional beams cover larger areas such as countries. Regional beams are generated by combining a plurality of spot beams. Spot beams are generated by energizing the radiating elements with selected amplitudes and phases. A reconfigurable multiple beam array antenna should be capable of reconfiguring the location of the beams, the size of the beams, and the power radiated in each beam.

What is needed is a reconfigurable multiple beam array antenna in which reconfigurability is achieved by selecting radiating elements of the array to excite for generating beams.

SUMMARY OF THE INVENTION

Accordingly, it is an object of the present invention to provide a reconfigurable multiple beam array antenna in which any radiating element can be selected for any given input beam port.

It is another object of the present invention to provide a reconfigurable multiple beam array antenna which may use all the radiating elements for each beam.

It is a further object of the present invention to provide a reconfigurable multiple beam array antenna which may use only one radiating element for each beam.

It is still another object of the present invention to provide a reconfigurable multiple beam array which includes a reconfigurable beam forming network having dividers, phase shifter and attenuator pairs, and combiners.

In carrying out the above objects and other objects, the present invention provides a reconfigurable multiple beam array antenna for transmitting beams. The array antenna includes a reflector and a plurality of radiating elements arranged in either a planar or a spherical surface for feeding beam signals to the reflector. The array antenna further includes a reconfigurable beam forming network having a plurality of dividers, a plurality of adjustable phase shifter and attenuator pairs, and a plurality of combiners to form beam signals from beam signals input to the beam forming network. A first hybrid matrix formed by an association of couplers is connected to the beam forming network for receiving the beam signals from the beam forming network. A plurality of amplifiers receives and amplifies the beam signals from the first hybrid matrix. A second hybrid matrix formed by an association of couplers is connected to the plurality of amplifiers for receiving the beam signals from the plurality of amplifiers. The second hybrid matrix provides the amplified beam signals to the plurality of radiating elements for the reflector to transmit beams.

In accordance with the array antenna for transmitting beams, a reconfigurable multiple beam array antenna for receiving beams is also provided.

The advantages accruing to the present invention are numerous. Multiple beams with widely shaped coverages can be generated unlike the conventional approaches which generate uniform sized spot beams. The reflector of the array antenna can be gimballed to scan the beams over a wide-angular area using only a relatively small feed array and low order hybrid matrices. Further, the array antenna can be easily reconfigured to compensate for on orbit failures of the amplifiers and, thus, requires a relatively small number of redundancies. Compensation can be achieved by using a different set of beam forming network output port excitations which will optimize the given beam shapes taking into account the failure of a particular amplifier.

These and other features, aspects, and embodiments of the present invention will become better understood with regard to the following description, appended claims, and accompanying drawings.

BEST MODES FOR CARRYING OUT THE INVENTION

Figure 1:
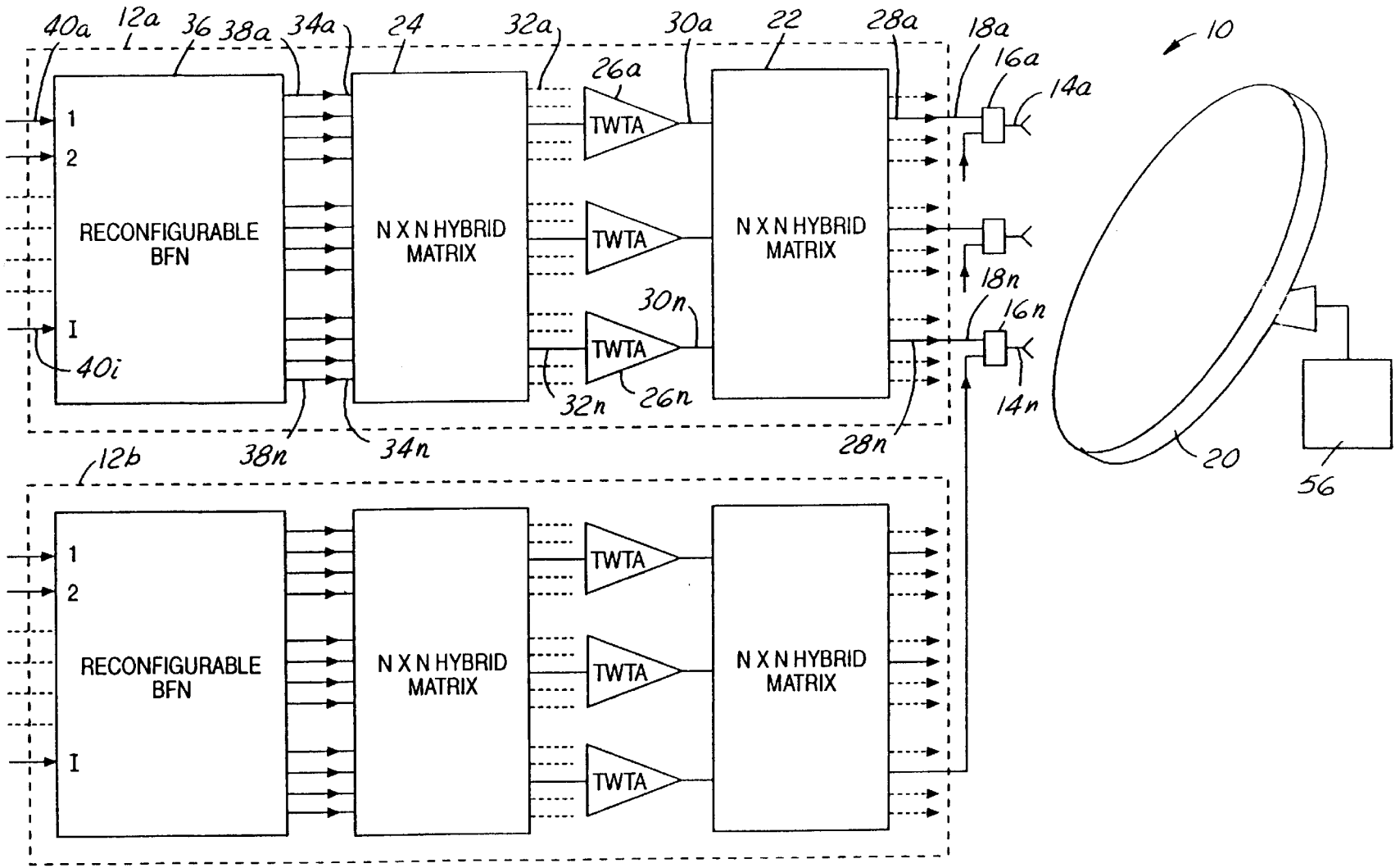
FIG. 1 is a block diagram of a reconfigurable multiple beam array antenna according to a first embodiment of the present invention for transmitting beams.

Referring now to FIG. 1, a reconfigurable multiple beam array antenna 10 according to a first embodiment of the present invention is shown. Array antenna 10 is operable for transmitting beams and is intended for use on a satellite (not specifically shown in FIG. 1). Array antenna 10 includes right and left hand circular polarization antenna subsystems 12*a* and 12*b* connected to N radiating elements 14(*a–n*) by respective polarizers 16(*a–n*) along separate individual feed chains 18(*a–n*). Radiating elements 14(*a–n*) are arranged in either a planar surface for small coverages or along a spherical surface for large coverages and feed a reflector 20. Of course, radiating elements may feed a subreflector which then feeds reflector 20. Radiating elements 14(*a–n*) can be located close to the focal plane of reflector 20 or over a plane which can be defocused from the focal plane. Preferably, radiating elements 14(*a–n*) are defocused and located several wavelengths away from the focal plane of reflector 20 in order to provide better reconfigurability of the beams. Because antenna subsystems 12*a* and 12*b* include the same elements, only antenna subsystem 12*a* will be described in further detail.

Antenna subsystem 12*a* includes a pair of N×N hybrid matrices 22 and 24 connected back to back by N amplifiers 26(*a–n*). Amplifiers 26(*a–n*) are distributed non-redundant traveling wave tube amplifiers (TWTA) or solid state power amplifiers (SSPA). Output hybrid matrix (OHM) 22 includes N OHM output ports 28(*a–n*) and N OHM input ports 30(*a–n*). Each one of OHM output ports 28(*a–n*) is connected to a respective one of radiating elements 14(*a–n*) along respective individual feed chains 18(*a–n*). Each one of OHM input ports 30(*a–n*) is connected to the output of a respective one of amplifiers 26(*a–n*). Input hybrid matrix (IHM) 24 includes N IHM output ports 32(*a–n*) and N IHM input ports 34(*a–n*). Each one of IHM output ports 32(*a–n*) is connected to the input of a respective one of amplifiers 26(*a–n*). (The redundancy schematic for amplifiers 26(*a–n*) is not shown in FIG. 1.)

Antenna subsystem 12*a* further includes a reconfigurable beam forming network (BFN) 36. BFN 36 includes N BFN output ports 38(*a–n*) and I BFN beam input ports 40(*a–i*). Each one of BFN output ports 38(*a–n*) is connected to a respective one of IHM input ports 34(*a–n*).

Figure 2:
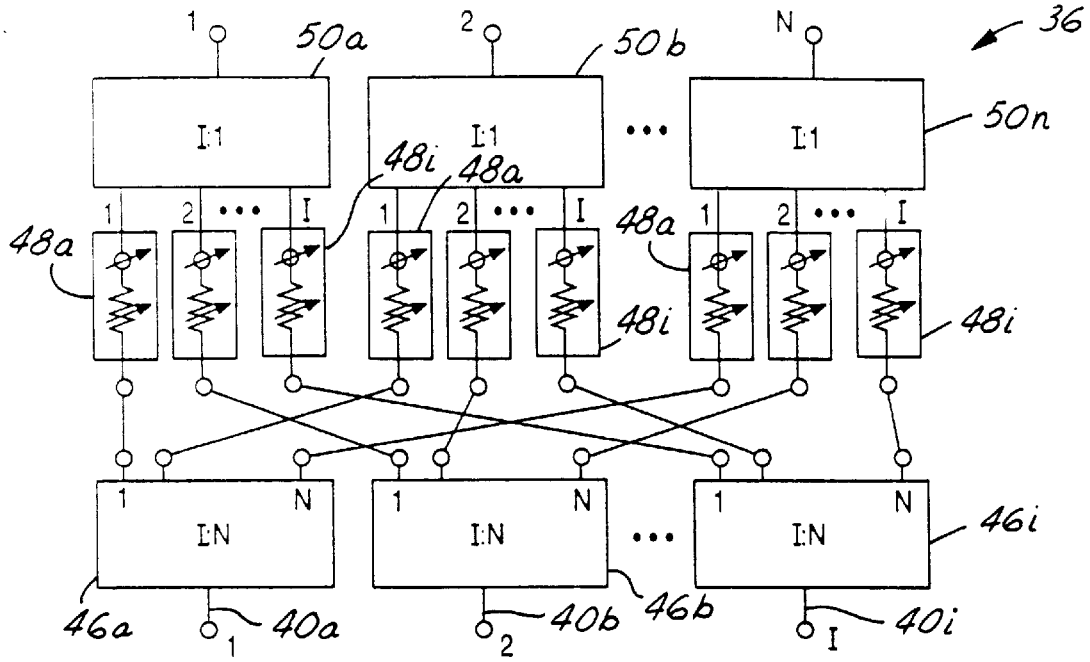
FIG. 2 is a block diagram of the beam forming network of the array antenna shown in FIG. 1.

Referring now to FIG. 2 with continual reference to FIG. 1, a block diagram of BFN 36 is shown. BFN 36 excites any specified number of BFN output ports 38(*a–n*) by processing signals input to the BFN from BFN beam input ports 40(*a–i*). Hence, radiating elements 14(*a–n*) corresponding to BFN output ports 38(*a–n*) are also excited (as discussed below) to form beams. Thus, beams with different locations, sizes, and power levels can be generated by reconfiguring BFN output ports 38(*a–n*) for each one of BFN beam input ports 40(*a–i*).

BFN 36 includes I (1:N) dividers 46(*a–i*), N (I:1) combiners 50(*a–n*), and I variable phase shifter and attenuator pairs 48(*a–i*) associated with each of the N combiners. Dividers 46(*a–i*) divide each one of the I beam signals from BFN beam input ports 40(*a–i*) into N beam signals.

Each one of the divided N beam signals from dividers 46(*a–i*) is routed to a phase shifter and attenuator pair 48(*a–i*). For instance, the first divided beam signal from divider 46*a* is routed to the first phase shifter and attenuator pair 48*a* associated with combiner 50*a*. Similarly, the second divided beam signal from divider 46*a* is routed to first phase shifter and attenuator pair 48*a* associated with combiner 50*b*. The Nth divided beam signal from divider 46*a* is routed to the first phase shifter and attenuator pair 48*a* associated with the Nth combiner 50*n*.

This routing pattern is followed for each of the other dividers 46(*b–i*). For instance, the first divided beam signal from divider 46*b* is routed to the second phase shifter and attenuator pair 48*b* associated with combiner 50*a*. Similarly, the second divided beam signal from divider 46*b* is routed to second phase shifter and attenuator pair 48*b* associated with combiner 50*b*. The Nth divided beam signal from divider 46*i* is routed to the Ith phase shifter and attenuator pair 48*i* associated with the Nth combiner 50*n*.

Phase shifter and attenuator pairs 48(*a–i*) vary the phase and amplitude of each of the divided N beam signals from dividers 46(*a–i*). Phase shifter and attenuator pairs 48(*a–i*) are active components used to form the beams. Phase shifter and attenuator pairs 48(*a–i*) output the phase shifted and amplitude adjusted I divided beam signals to their associated combiners 50(*a–n*). Each of combiners 50(*a–n*) combines the I divided beam signals from their associated phase shifter and attenuator pairs 48(*a–i*) into a combined beam signal. The combined beam signals from combiners 50(*a–n*) are output on respective ones of BFN output ports 38(*a–n*). A pair of N×I variable phase shifter and attenuator pairs are required to provide the complete reconfigurability.

Figure 3:
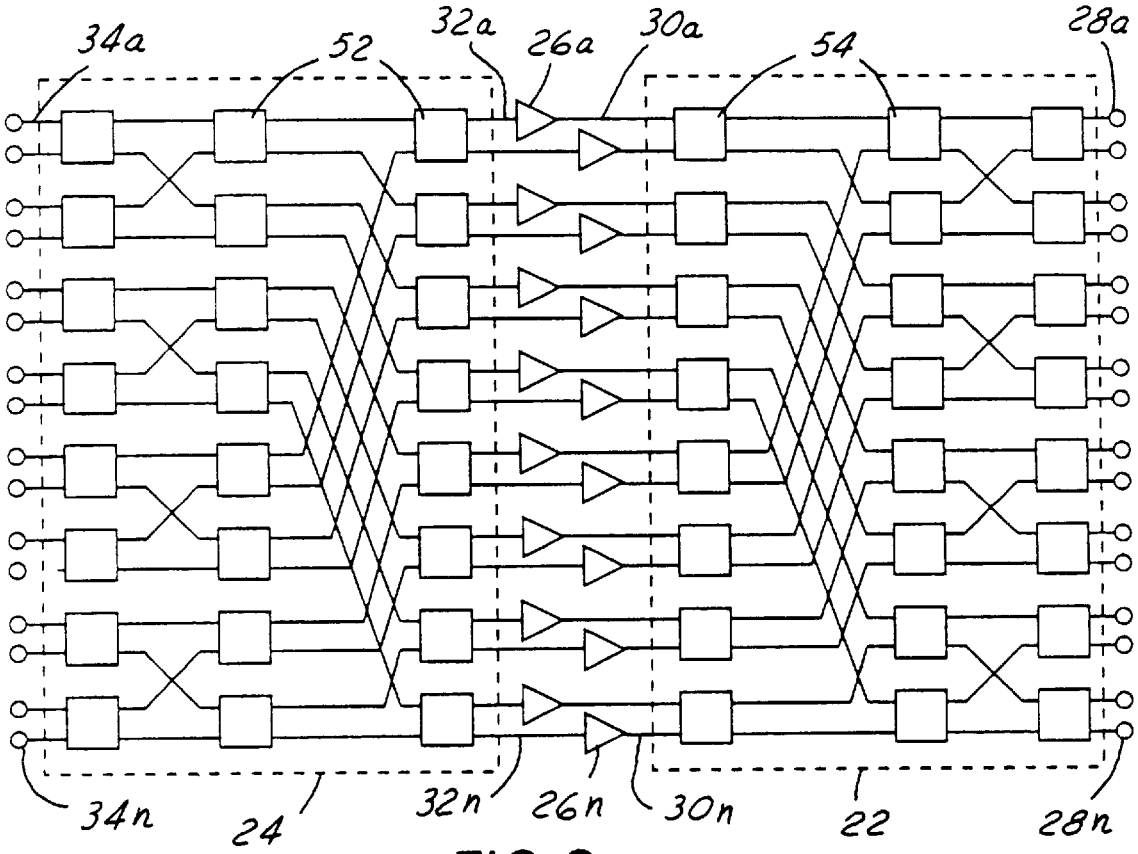
FIG. 3 is a block diagram of the pair of hybrid matrices and amplifiers of the array antenna shown in FIG. 1.

Referring now to FIG. 3 with continual reference to FIG. 1, the combined beam signals from combiners 50(*a–n*) are input from BFN output ports 38(*a–n*) to IHM 24 via respective IHM input ports 34(*a–n*). In general, IHM 24 and OHM 22 generate the image of each one of IHM input ports 34(*a–n*) on the corresponding OHM output port 28(*a–n*) and so excite a particular one of radiating elements 14(*a–n*). Thus, a number of radiating elements 14(*a–n*) can be excited by selecting the corresponding number of IHM input ports 34(*a–n*) (or BFN output ports 38(*a–n*)).

IHM 24 equally divides the combined beam signal on each one of IHM input ports 34(*a–n*) into N divided signals having a systematic phase difference. The N divided signals are then output onto corresponding IHM output ports 32(*a–n*). The N divided signals from IHM output ports 32(*a–n*) are amplified by respective ones of N amplifiers 26(*a–n*) and then input to OHM 22 via OHM input ports 30(*a–n*). OHM 22 combines the amplified N divided signals from OHM input ports 30(*a–n*) systematically to remove the phase differences between the signals and then outputs the combined signals onto corresponding OHM output ports 28(*a–n*). The combined signals from OHM output ports 28(*a–n*) are then fed to radiating elements 14(*a–n*) along respective feed chains 18(*a–n*).

Radiating elements 14(*a–n*) then feed reflector 20 for the reflector to transmit beams. A gimballing mechanism 56 is operable with reflector 20 to rotate and tilt the reflector. The rotation and tilting of reflector 20 enables the transmitted beams to be steered to obtain global reconfigurability.

Because each one of OHM output ports 28(*a–n*) is connected to a respective one of radiating elements 14(*a–n*), each one of IHM input ports 34(*a–n*) and BFN output ports 38(*a–n*) corresponds to a specific radiating element. Thus, BFN 36 allows any specific number of radiating elements 14(*a–n*) to be selected to form a beam for a given one of BFN beam input ports 40(*a–i*). Multiple beams can be formed by associating different combinations of radiating elements 14(*a–n*) to BFN beam input ports 40(*a–i*). By varying the input power levels to BFN beam input ports 40(*a–i*), the power associated with different beams can also be controlled.

The amplified signals on OHM output ports 28(*a–n*) were amplified using the power from all of amplifiers 26(*a–n*). This is highly advantageous because it is difficult to sum beams of different phases and amplitudes without giving rise to losses. If summing is performed prior to amplification to obtain the generated beams, amplifiers 26(*a–n*) will be loaded differently and as a result it is no longer possible to obtain linear amplification or constant gain.

In order to load amplifiers 26(*a–n*) uniformly, IHM 24 and OHM 22 are used to get as close as possible to optimum operating conditions with each one of amplifier 26(*a–n*) providing optimum efficiency while working at optimum operating points. IHM 24 includes 3 dB couplers 52 arranged such that the combined beam signal on each one of IHM input ports 34(*a–n*) is equally divided into N divided signals having a systematic phase difference. This gives rise to a uniform load distribution over all of the inputs of amplifiers 26(*a–n*).

OHM 22 includes 3 dB couplers 54 arranged to combine the amplified N divided signals systematically to remove the phase differences between the signals. Thus, the original signals from BFN output ports 38(*a–n*) are recovered after amplification. The arrangement of 3 dB couplers 54 of OHM 22 is inverse to the arrangement of 3 dB couplers 52 of IHM 24.

Figure 4:
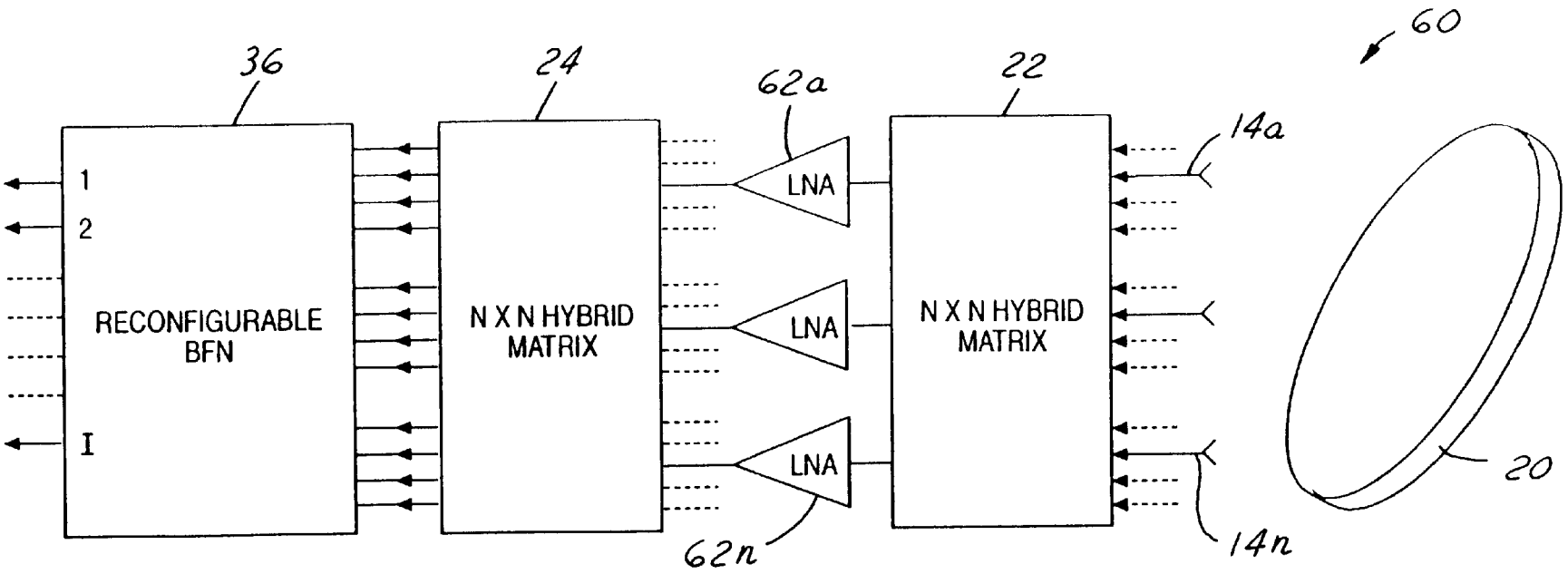
FIG. 4 is a block diagram of a reconfigurable multiple beam array antenna according to a second embodiment of the present invention for receiving beams.

Referring now to FIG. 4, a reconfigurable multiple beam array antenna 60 (for single polarization) according to a second embodiment of the present invention is shown. Array antenna 60 is operable for receiving beams and is intended for use on a satellite (not specifically shown in FIG. 4). Array antenna 60 generally includes the same elements as array antenna 10 shown in FIG. 1. Array antenna 60 differs from array antenna 10 by including N low noise amplifiers (LNA) 62(*a–n*) connected between the pair of hybrid matrices 22 and 24.

For array antenna 60 to operate in the receive mode, the above described procedure of array antenna 10 is reversed. For instance, OHM 22 performs the function of IHM 24 and the IHM performs the function of the OHM to supply signals to BFN 36. In BFN 36, referring briefly to FIG. 2, each one of combiners 50(*a–n*) functions to divide the supplied signal into I signals. The I divided signals from each one of combiners 50(*a–n*) are then provided to phase shifter and attenuator pairs 48(*a–i*) associated with the respective combiners. Phase shifter and attenuator pairs 48(*a–i*) adjust the phase and amplitude of the signals and then route the signals to associated dividers 46(*a–i*). Each one of dividers 46(*a–i*) receives N signals and combines the N signals into one signal. The combined signals are then provided onto BFN beam input ports 40(*a–i*) for processing.

Figure 5:
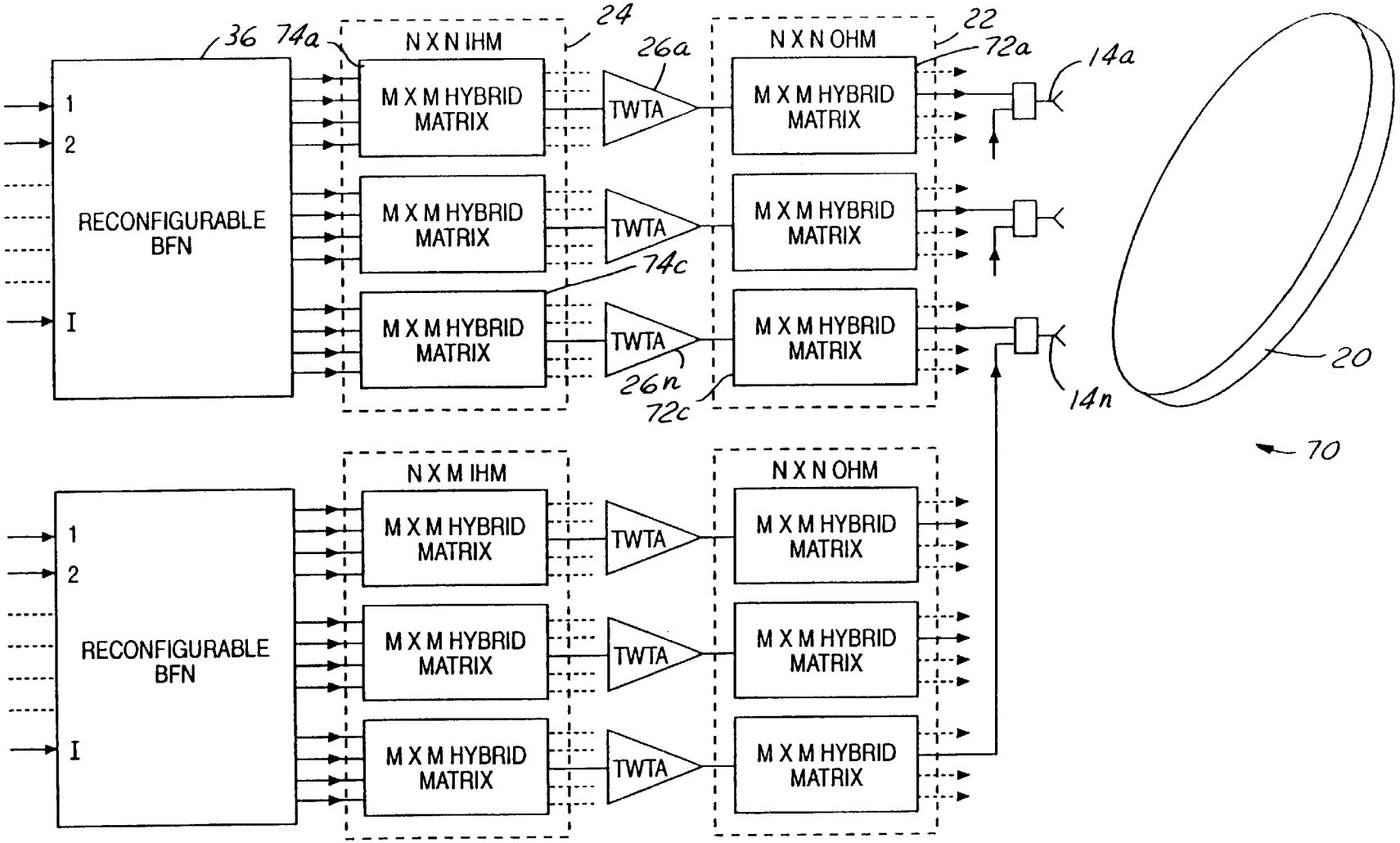
FIG. 5 is a block diagram of a reconfigurable multiple beam array antenna according to a third embodiment of the present invention for transmitting beams.

Referring now to FIG. 5, a reconfigurable multiple beam array antenna 70 according to a third embodiment of the present invention is shown. Array antenna 70 is operable for transmitting beams and is intended for use on a satellite (not specifically shown in FIG. 5). Array antenna 70 generally includes the same elements as shown in FIG. 1 for array antenna 10. Array antenna 70 differs from array antenna 10 by replacing OHM 22 and IHM 24 with a group of M×M hybrid matrices 72(*a–c*) and 74(*a–c*). The N and M orders are related by the equation N=cM where c is the number of hybrid matrices 72(*a–c*) and 74(*a–c*). Using smaller ordered matrices is desirable with applications involving large values of N in which an N×N matrix is too complex to build.

Figure 6:
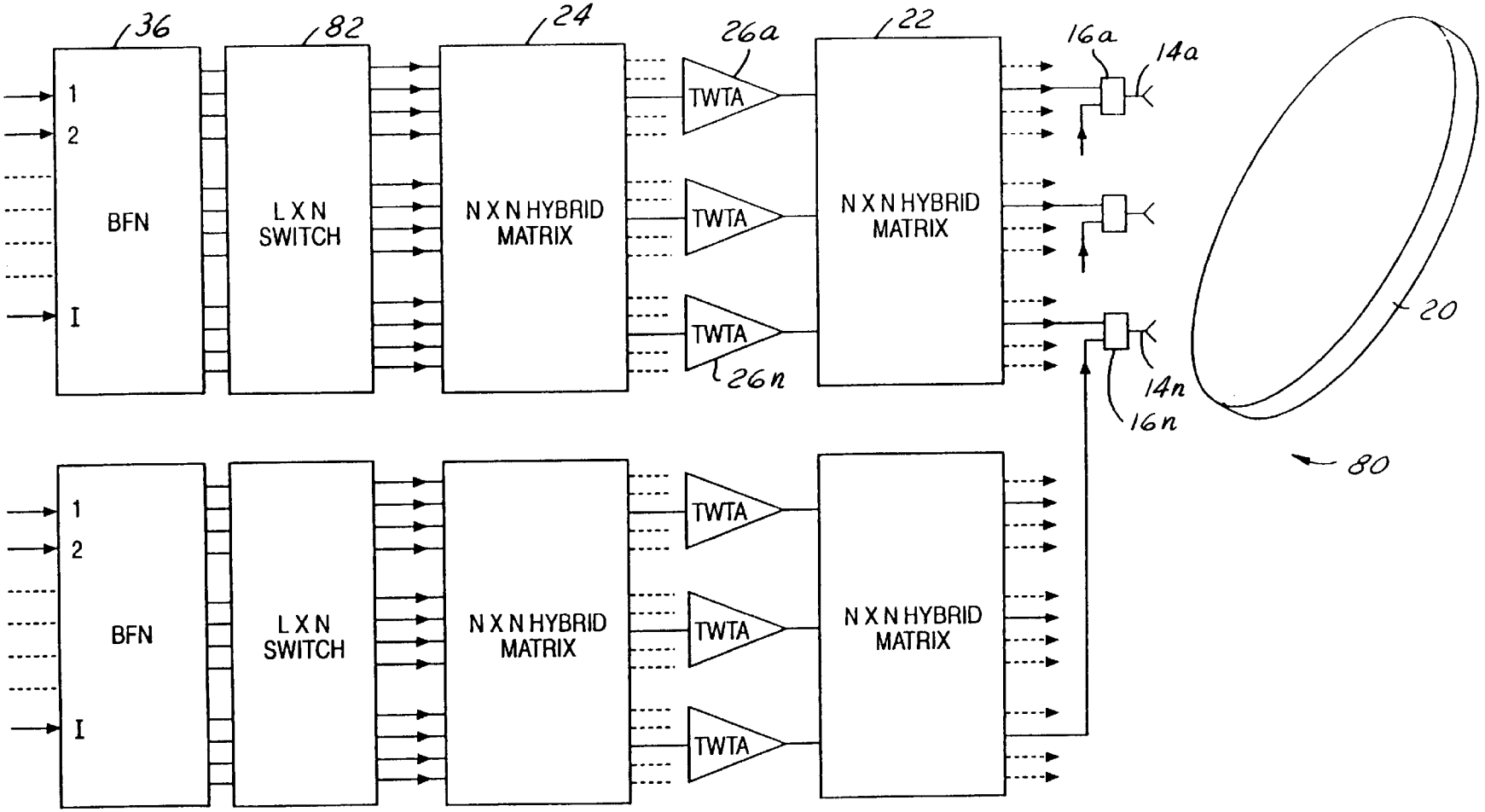
FIG. 6 is a block diagram of a reconfigurable multiple beam array antenna according to a fourth embodiment of the present invention for transmitting beams.

Referring now to FIG. 6, a reconfigurable multiple beam array antenna 80 according to a fourth embodiment of the present invention is shown. Array antenna 80 is operable for transmitting beams and is intended for use on a satellite (not specifically shown in FIG. 6). Array antenna 80 generally includes the same elements as shown in FIG. 1 for array antenna 10. Array antenna 80 differs from array antenna 10 by including a L×N switch 82. Switch 82 allows BFN 36 to be simpler to operate by operating on a subset of radiating elements 14(*a–n*) instead of operating on all the radiating elements.

A smaller subset (up to L) of radiating elements 14(*a–n*) can be selected by switch 82 thus forming beams over a smaller region of the Earth. By selecting different subsets, beams can be formed in different parts of the Earth. In this configuration, radiating elements 14(*a–n*) and OHM 22 and IHM 24 are designed for a larger coverage region but BFN 36 is designed for a smaller coverage region.

The present invention is applicable to satellite based communications. It is particularly of interest to future communications satellites such as personal communications satellites (PCS), direct broadcast satellites (DBS), and mobile communications satellites involving a moderate to large number of multiple beams.

Thus it is apparent that there has been provided, in accordance with the present invention, a reconfigurable multiple beam array antenna that fully satisfies the objects, aims, and advantages set forth above.

The present invention allows a single antenna to be used for a wide variety of customer requirements, resulting in a generic antenna design with an associated reduction of cost and schedule. As an example, the same antenna design can be used for a large country such as the United States or a small country such as Greece. This may lead to multiple satellites to be manufactured with the option of customizing prior to launch or even on-orbit. The satellites can be moved from one orbit to another with minimum performance degradation. The reconfigurability reduces the burden on determining marketing needs.

While the present invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A reconfigurable multiple beam array antenna for transmitting beams comprising:

a reflector;

a plurality of radiating elements for feeding beam signals to the reflector;

a reconfigurable beam forming network, the beam forming network including a plurality of dividers, a plurality of adjustable phase shifters and attenuator pairs, and a plurality of combiners to form beam signals from beam signals input to the beam forming network;

a first hybrid matrix formed by an association of couplers connected to the beam forming network for receiving the beam signals from the beam forming network;

a plurality of amplifiers for receiving and amplifying the beam signals from the first hybrid matrix; and a second hybrid matrix formed by an association of couplers connected to the plurality of amplifiers for receiving the beam signals from the plurality of amplifiers, wherein the second hybrid matrix provides the amplified beam signals to the plurality of radiating elements for the reflector to transmit beams.

2. The array antenna of claim 1 wherein:

the plurality of radiating elements are located on the focal plane of the reflector.

3. The array antenna of claim 1 wherein:

the plurality of radiating elements are located over a plane which is defocused from the focal plane of the reflector.

4. The array antenna of claim 1 wherein:

the couplers of the first and second hybrid matrices are 3 dB couplers.

5. The array antenna of claim 1 wherein:

the plurality of amplifiers are traveling wave tube amplifiers.

6. The array antenna of claim 1 wherein:

the plurality of amplifiers are solid state power amplifiers.

7. The array antenna of claim 1 wherein:

the plurality of dividers divide each one of the beam signals input to the beam forming network into divided beam signals and then routes the divided beam signals to the phase shifters and attenuator pairs.

8. The array antenna of claim 7 wherein:

the phase shifters and attenuator pairs adjust the phase and amplitude of the divided beam signals and then provide the adjusted divided beam signals to the combiners.

9. The array antenna of claim 8 wherein:

the combiners combine the adjusted divided beam signals into the output beam signals.

10. The array antenna of claim 1 wherein:

the first and second hybrid matrices include a plurality of hybrid matrices.

11. The array antenna of claim 1 further comprising:

a switch which connects the beam forming network to the first hybrid matrix.

12. The array antenna of claim 1 further comprising:

a gimballing mechanism for tilting and rotating the reflector to steer the transmitted beams.

13. A reconfigurable multiple beam array antenna for receiving beams comprising:

a reflector;

a plurality of radiating elements for receiving beam signals from the reflector;

a first hybrid matrix formed by an association of couplers connected to the plurality of radiating elements for receiving the beam signals from the plurality of radiating elements;

a plurality of amplifiers for receiving and amplifying the beam signals from the first hybrid matrix;

a second hybrid matrix formed by an association of couplers connected to the plurality of amplifiers for receiving the amplified beam signals from the plurality of amplifiers; and a reconfigurable beam forming network, the beam forming network including a plurality of dividers, a plurality of adjustable phase shifters and attenuator pairs, and a plurality of combiners to form beam signals from the amplified beam signals input to the beam forming network from the second hybrid matrix.

14. The array antenna of claim 13 wherein:

the plurality of amplifiers are low noise amplifiers.

* * * * *